US006688718B1

(12) United States Patent
Steinfield et al.

(10) Patent No.: US 6,688,718 B1
(45) Date of Patent: Feb. 10, 2004

(54) HEAT TRANSFER DEVICE FOR AN INKJET PRINTER

(75) Inventors: Steven W. Steinfield, San Diego, CA (US); Joseph E. Scheffelin, Poway, CA (US); William S. Colburn, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/347,079

(22) Filed: Jul. 2, 1999

(51) Int. Cl.[7] ..... B41J 29/377; B41J 2/175
(52) U.S. Cl. ..... 347/18; 347/87
(58) Field of Search ..... 29/890.1, 611; 347/18, 87, 44

(56) References Cited

U.S. PATENT DOCUMENTS 5,367,328 A * 11/1994 Erickson ..... 347/85
5,852,460 A * 12/1998 Schaeffer et al. ..... 347/87
5,936,649 A * 8/1999 Ikeda et al. ..... 347/87
6,076,912 A * 6/2000 Murthy ..... 347/18

* cited by examiner

*Primary Examiner*—Stephen D. Meier
*Assistant Examiner*—Julian D. Huffman

(57) ABSTRACT

This present invention is embodied in a printing system with thermally efficient heat transfer capabilities for reducing dimpling of a nozzle member during fabrication of the printhead portion of an inkjet printer. The printing system of the present invention includes a printhead assembly and an ink supply for printing ink on print media. The printhead assembly includes a printhead body having a heat transfer device, ink channels and a nozzle member having plural nozzles coupled to respective ink channels. The nozzle member is secured to the printhead body with a suitable adhesive layer. The heat transfer device can be defined by a portion of or the entire printhead body for reducing thermal expansion of the printhead body during exposure to heat. Namely, the heat transfer device of the printing system of the present invention is capable of efficiently reducing thermal expansion of the printhead body during the process of adhering (which includes heating and curing the adhesive) the nozzle member to the printhead body. As a result, trajectory errors of ejected ink droplets from the nozzles are reduced.

9 Claims, 3 Drawing Sheets

HEAT TRANSFER DEVICE FOR AN INKJET PRINTER

FIELD OF THE INVENTION

The present invention generally relates to inkjet and other types of printers and more particularly, to a printing system with thermally efficient heat transfer capabilities for a printhead portion of an inkjet printer.

BACKGROUND OF THE INVENTION

Inkjet printers are commonplace in the computer field. These printers are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more print cartridges each having a printhead with a nozzle member having ink ejecting nozzles. The carriage traverses over the surface of the print medium. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed.

In general, the small drops of ink are ejected from the nozzles through orifices by rapidly heating a small volume of ink located in vaporization chambers with small electric heaters, such as small thin film resistors. The small thin film resistors are usually located adjacent the vaporization chambers. Heating the ink causes the ink to vaporize and be ejected from the orifices. Specifically, for one dot of ink, an electrical current from an external power supply is passed through a selected thin film resistor of a selected vaporization chamber. The resistor is then heated for superheating a thin layer of ink located within the selected vaporization chamber, causing explosive vaporization, and, consequently, a droplet of ink is ejected from the nozzle and onto a print media. One very important factor in assuring high print quality is the accuracy of the trajectory of the ejected droplet since this affects where it lands upon the print media. The accuracy of this trajectory is mostly dependent upon the particular geometry of the nozzle.

One challenge in controlling the nozzle geometry and hence trajectory of the droplets is to regulate bending and/or buckling of the nozzle member, otherwise known as "dimpling" of the nozzle member. Dimpling of the nozzle member causes the nozzles to be skewed, which leads to imprecise nozzle geometry. Dimpling tends to be induced during print cartridge manufacturing, which includes cartridge assembly processes such as adhesively bonding the printhead to the cartridge. More specifically, dimpling can be caused by inadvertent bending and/or buckling of the nozzle member due to structural thermal expansions and contractions occurring when the nozzle member is adhesively sealed to the print cartridge. For example, during the heat, cure and cool process when the nozzle member is adhered to the cartridge, the cartridge experiences thermal expansions and contractions. These thermal expansions and contractions cause the nozzle member to buckle, bend and deform, thereby skewing the nozzles. Typical heat and cure processes include curing the adhesive by applying hot air to the nozzle member, which heats an upper portion of the print cartridge.

Since dimpling of the nozzle member skews the nozzles, it tends to adversely affect nozzle geometry, thereby causing nozzle trajectory errors. A measure of this bending of the nozzle member is referred to as the "nozzle camber angle" (NCA), which is proportional to the bending of the nozzle member from an ideal flat state. Poor nozzle camber angles (NCAs) causes ink drop trajectory errors and uncontrolled ink drop directionality. In other words, when the printhead assembly is scanned across a recording medium, the NCA-induced ink drop trajectory errors will affect the location of printed dots and, thus, affect the quality of printing. Also, the bending of the nozzle member can restrict ink flow into nozzles, thus limiting the refill speed and hence the maximum droplet ejection frequency. This is turn limits printer speed. Therefore, what is needed is a nozzle member that has incurred limited bending or deformation during manufacturing of the print cartridge and to be as flat as possible. What is also needed is a printing system incorporating a device that reduces dimpling of a nozzle member during manufacture of a printhead portion of an inkjet printer.

SUMMARY OF THE INVENTION

To overcome the limitations in the prior art described above, and to overcome other limitations that will become apparent upon reading and understanding the present specification, the present invention is embodied in a printing system with thermally efficient heat transfer capabilities for reducing dimpling of a nozzle member during fabrication of the printhead portion of an inkjet printer.

The printing system of the present invention includes a printhead assembly and an ink supply for printing ink on print media. The printhead assembly includes a printhead body having a heat transfer device, ink channels and a nozzle member having plural nozzles coupled to respective ink channels. The nozzle member is secured to the printhead body with a suitable adhesive layer. The heat transfer device can be defined by a portion of or the entire printhead body for reducing thermal expansion of the printhead body during exposure to heat. Namely, the heat transfer device of the printing system of the present invention is capable of efficiently reducing thermal expansion (which in turn reduces the thermal contraction) of the printhead body during the process of adhering (which includes heating and curing the adhesive) the nozzle member to the printhead body. As a result, trajectory errors of ejected ink droplets from the nozzles are reduced.

In another embodiment, a controlled process is used to heat and cure the adhesive for reducing the amount of heat applied to the printhead body, thereby reducing the thermal expansion of the printhead body. In particular, hot gimbaled rails can be placed in direct contact with the nozzle member to conductively heat and cure the adhesive directly below the contact area between the nozzle member and printhead body. Since the rails only contact the nozzle member, heat can be applied to localized areas with controlled amounts.

For instance, a minimum required amount of heat to cure the adhesive can be applied to a controlled area directly above the adhesive. As a result, only a portion of the printhead body is heated, thereby efficiently reducing thermal expansion of the printhead body. Consequently, trajectory errors of ejected ink droplets from the nozzles are reduced.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

General Overview

Figure 1:
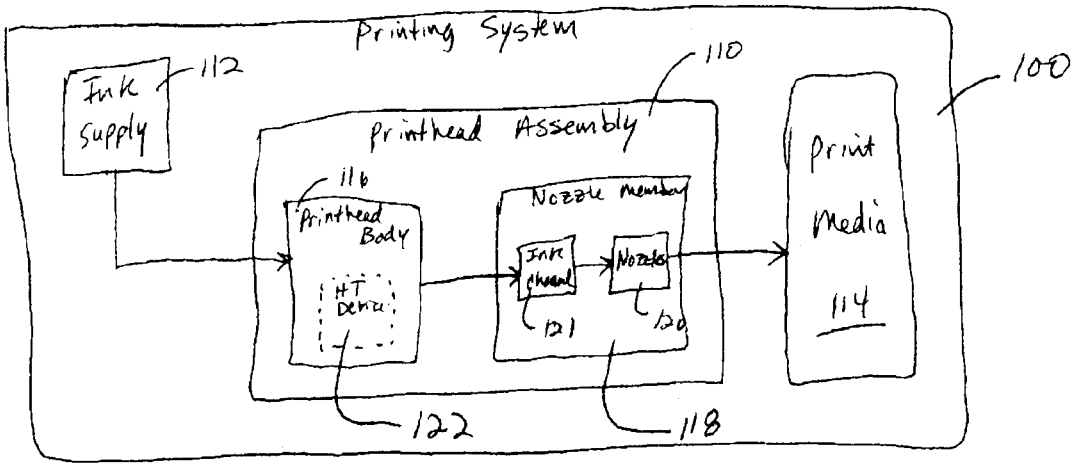
FIG. 1 shows a block diagram of an overall printing system incorporating the present invention.

FIG. 1 shows a block diagram of an overall printing system incorporating the present invention. The printing system 100 of the present invention includes a printhead assembly 110, an ink supply 112 and print media 114. The printhead assembly 110 includes a printhead body 116, a nozzle member 118 with orifices or nozzles 120 fluidically coupled to associated ink channels 121. The printhead body 116 includes a heat transfer device 122 for reducing the thermal expansion of the printhead body 116 during exposure to heat, which in turn reduces the thermal contraction during cooling. The nozzle member 118 is preferably fixedly coupled to the printhead body 116, such as with an adhesive.

During a printing operation, ink is provided from the ink supply 112 to an interior portion (such as an ink reservoir) of the printhead body 116. The interior portion of the printhead body 116 provides ink to the ink channels 121 for allowing ejection of ink through adjacent nozzles 120. Namely, the printhead assembly 110 receives commands from a processor (not shown) to print ink and form a desired pattern for generating text and images on the print media 114. Print quality of the desired pattern is dependent on accurate placement of the ink droplets on the print media 114.

One way to increase print quality is to improve the accuracy and precision of ink droplet placement. This can be achieved by limiting the skew of the nozzles by minimizing nozzle camber angles (NCA). In one embodiment, the present invention is embodied in a printhead body 116 with an aperture for efficiently limiting the thermal expansion of the printhead body 116 when exposed to heat during adhesion of the nozzle member 118 to the printhead body 116. In another embodiment, a controlled process is used to heat and cure the adhesive for reducing the amount of heat applied to the printhead body 116, thereby reducing the thermal expansion of the printhead body 116. In both cases, nozzle 120 skewing is reduced and NCA is improved. Consequently, trajectory errors for the ejected ink droplets from the nozzles 120 are reduced. It should be noted that the above embodiments could be performed in combination to further reduce thermal expansion of the printhead body.

Exemplary Printing System

Figure 2:
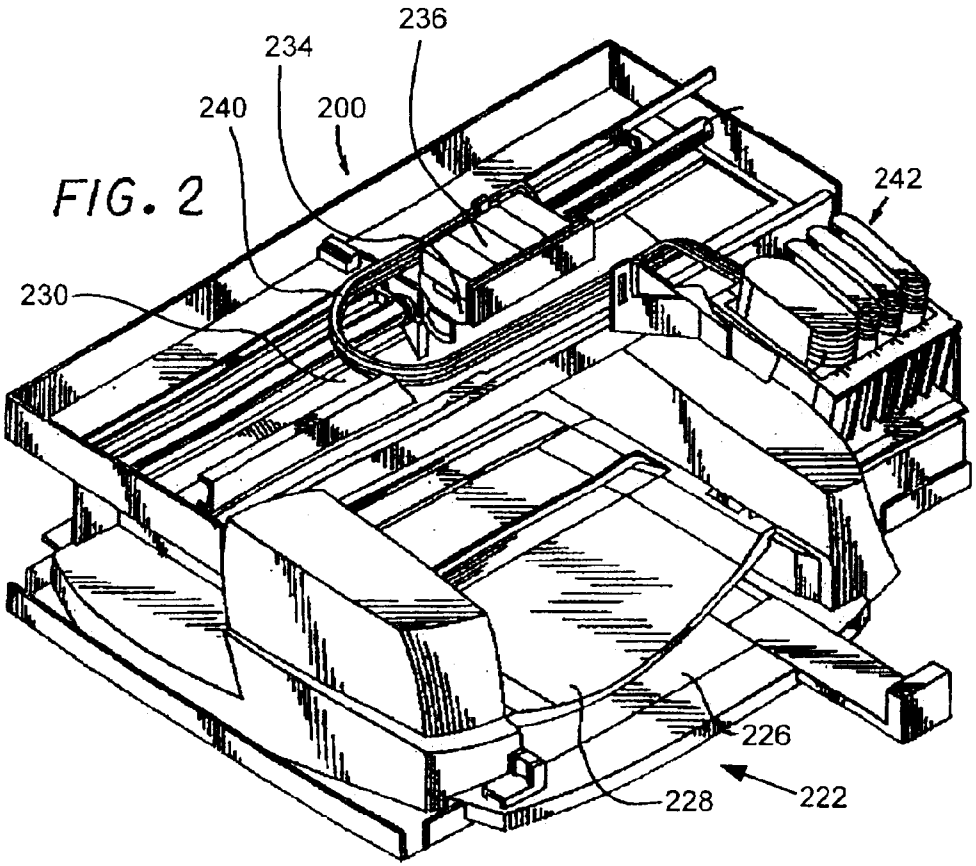
FIG. 2 is an exemplary printer that incorporates the invention and is shown for illustrative purposes only.

FIG. 2 is an exemplary high-speed printer that incorporates the invention and is shown for illustrative purposes only. Generally, printer 200 includes a tray 222 for holding print media 114 (shown in FIG. 1). When a printing operation is initiated, print media 114, such as a sheet of paper, is fed into printer 200 from tray 222 preferably using a sheet feeder 226. The sheet then brought around in a U direction and travels in an opposite direction toward output tray 228. Other paper paths, such as a straight paper path, can also be used. The sheet is stopped in a print zone 230, and a scanning carriage 234, supporting one or more print cartridges 236, is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) such as those incorporating grit wheel or drum technology to support and move the print media 114 relative to the printhead assembly 110. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 may be removeably mounted or permanently mounted to the scanning carriage 234. Also, the print cartridges 236 can have self-contained ink reservoirs in the body of the printhead (shown in FIG. 3) as the ink supply 112 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 112 (shown in FIG. 1). As a further alternative, ink supplies 112 can be one or more ink containers separate or separable from print cartridges 236 and removeably mountable to carriage 234.

Figure 3:
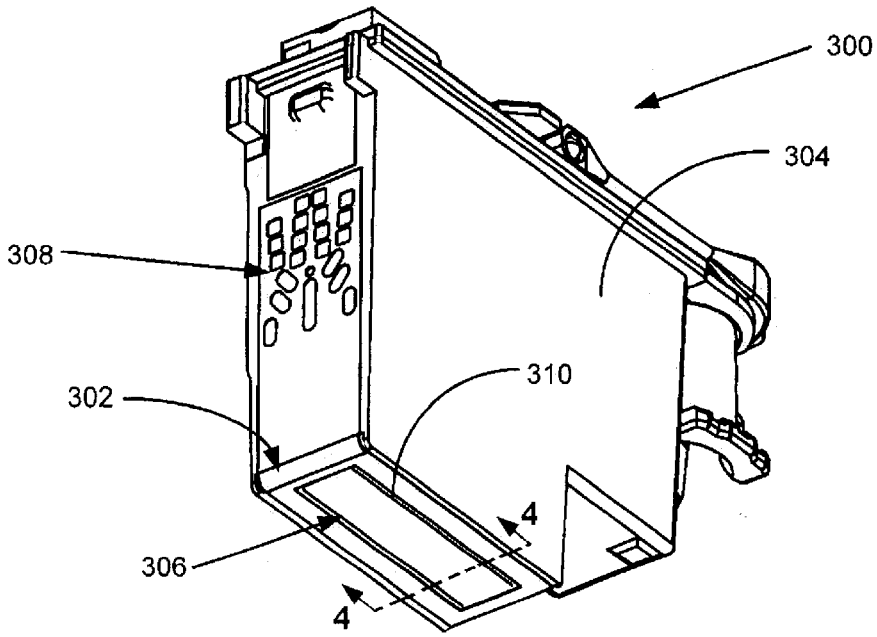
FIG. 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 110 of FIG. 1) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal head assembly 302 and a printhead body 304. The thermal head assembly 302 can be a flexible material commonly referred to as a Tape Automated Bonding (TAB) assembly. The thermal head assembly 302 contains a nozzle member 306 and interconnect contact pads 308 and is secured to the printhead assembly 300. The thermal head assembly 302 can be secured to the print cartridge 300 with suitable adhesives. An integrated circuit chip (not shown) provides feedback to the printer 200 regarding certain parameters of printhead assembly 300. The contact pads 308 align with and electrically contact electrodes (not shown) on carriage 234. The nozzle member 306 preferably contains plural parallel rows of offset nozzles 310 through the thermal head assembly 306 created by, for example, laser ablation. It should be noted that other nozzle arrangements can be used, such as non-offset parallel rows of nozzles.

Component Details

Figure 4:
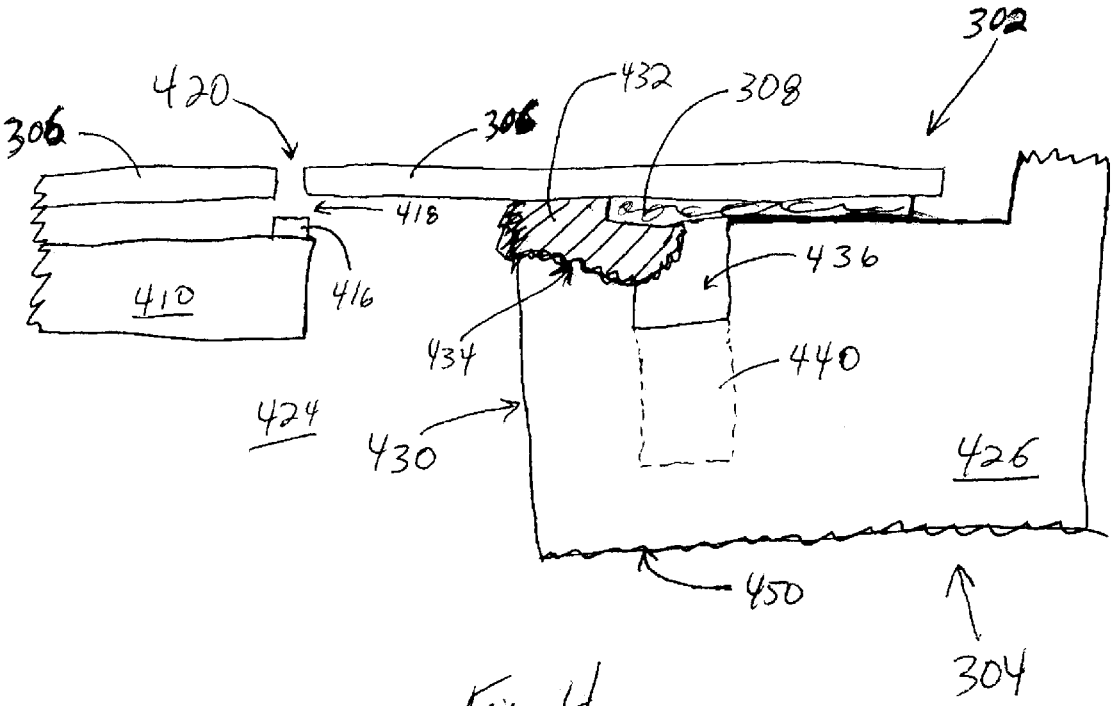
FIG. 4 is a schematic cross-sectional view taken through section line 4—4 of FIG. 3 showing the heat transfer device of the print cartridge of FIGS. 1 and 3.

FIG. 4 is a cross-sectional schematic taken through section line 4—4 of FIG. 3 of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of thermal head assembly 302 and terminate in contact pads 308 for contacting electrodes on carriage 234. The other ends of the conductors are bonded to the printhead 302 via terminals or electrodes (not shown) of a substrate 410. The substrate 410 has ink ejection elements 416 formed thereon and electrically coupled to the conductors. The integrated circuit chip provides the ink ejection elements 416 with operational electrical signals.

An ink ejection or vaporization chamber 418 is adjacent each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzles 420 can be located in other areas of the nozzle member 306, such as centered between an edge of the substrate 410 and an interior side of the body 304. Each ink ejection element 416 acts as ohmic heater when selectively energized by one or more pulses applied sequentially or simultaneously to one or more of the contact pads 308 via the integrated circuit. The ink ejection elements 416 may be heater resistors or piezoelectric elements. The orifices 420 may be of any size, number, and pattern, and the various figures are designed to simply and clearly show the features of the invention. The relative dimensions of the various features have been greatly adjusted for the sake of clarity.

The printhead body 304 is defined by a headland portion 426 located proximate to the back surface of the nozzle member 306 and includes an inner raised support 430. An adhesive layer 432 is located between the back surface of the nozzle member 306 and a top surface 434 of the inner raised support 430 to securely affix the nozzle member 306 to the headland 426. The inner raised support 430 preferably includes an overflow slot 436 for receiving excess adhesive (i.e., adhesive overflow during fabrication of the printhead). The adhesive layer 432 forms an adhesive seal between the nozzle member 306 of the thermal head assembly 302 and the headland 426. Some adhesives that can be used include hot-melt, silicone, UV curable adhesive, and mixtures thereof. Further, a patterned adhesive film may be positioned on the headland 426, as well as a dispensed bead of adhesive.

Referring to FIGS. 1–4, during a printing operation, ink stored in an ink reservoir 424 defined by the printhead body 304 generally flows around the edges of the substrate 410 and into the vaporization chambers 418. Energization signals are sent to the ink ejection elements 416 and are produced from the electrical connection between the print cartridges 236 and the printer 200. Upon energization of the ink ejection elements 416, a thin layer of adjacent ink is superheated to provide explosive vaporization and, consequently, cause a droplet of ink to be ejected through the orifice or nozzle 420. The vaporization chamber 418 is then refilled by capillary action. This process enables selective deposition of ink on print media 114 to thereby generate text and images.

During typical fabrication of the printhead assembly 300 and adhesion of the nozzle member 306 to the headland 426, dimpling is usually formed in the nozzle member 306 and thermal head assembly 302. Dimpling is caused by inadvertent bending or deformation of the nozzle member 306 and thermal head assembly 302. Bending and deformation can be caused by disproportionate thermal expansion and contraction of the headland 426 as compared to the thermal expansion and contraction of the nozzle member 306. In other words, since the nozzle member 306 and the headland 426 are typically made of different materials, their respective coefficients of thermal expansion and contraction are different so they deform disproportionately.

Thermal expansion occurs when a dispersed (non-localized) heat source, such as hot air, is applied to the nozzle member 306 to initiate curing of the adhesive. Thermal contraction occurs when cooling is applied to the nozzle member 306 to finalize curing of the adhesive and seal the nozzle member 306 to the headland 426. This dimpling of the nozzle member 306 creates skewed nozzles 420, thereby causing trajectory errors for the ejected ink droplets from the nozzles 420. Consequently, when the printhead assembly 300 is scanned across the print media during printing, the ink trajectory errors will affect the location of the ejected ink and reduce the quality of printing.

In one embodiment, the headland 426 of the present invention includes an integrated heat transfer device 440 for reducing thermal expansion of the printhead body 304. The integrated heat transfer device 440 can be any suitable device for reducing the thermal expansion of the headland 426 by reducing the temperature of the bulk volume of the headland 426 during exposure to heat, such as when the adhesive is heated to initiate curing. For example, as shown in FIG. 4, the heat transfer device 440 can be an aperture or cutaway portion of the headland 426. The aperture or cutaway 440 reduces the cross sectional area of the headland 426, thereby minimizing heat transfer from the curing adhesive 432 to the printhead body 304 and headland 426. As a result, dimpling is reduced because thermal expansion of the headland 426 is reduced during exposure to heat when the nozzle member 306 is adhesively sealed to the headland 426.

Specifically, this can be accomplished, for example, by having the integrated heat transfer device 440, such an aperture or cutaway, located in close proximity to the bottom portion 450 of the inner raised support 430. This reduces a cross sectional portion of the headland 426, thereby reducing heat transfer to a top portion of the headland 426 and thus, limiting thermal expansion of the headland 426. For instance, the aperture or cutaway 440 can be located near the overflow slot 436 and between the bottom portion 450, as shown in FIG. 4.

Figure 5:
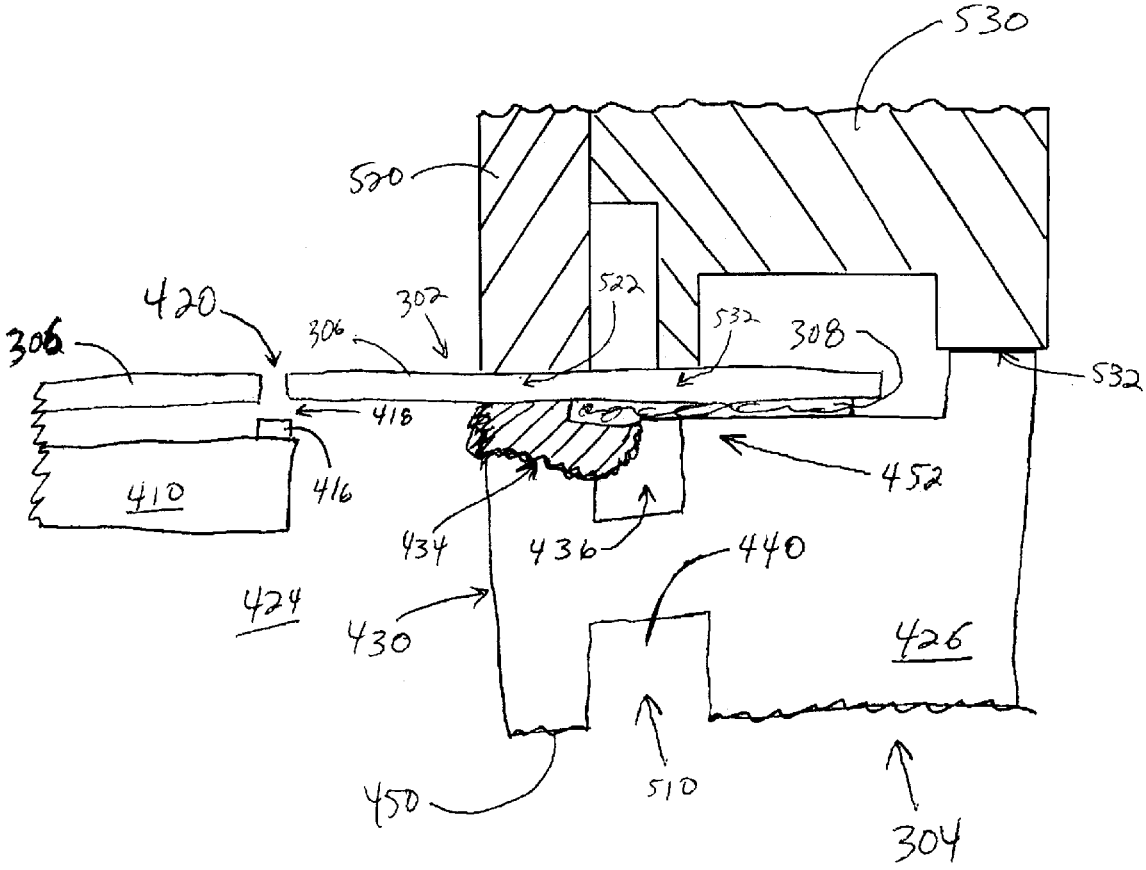
FIG. 5 is a schematic cross-sectional view taken through section line 4—4 of FIG. 3 showing another heat transfer device of the print cartridge of FIGS. 1 and 3 and a controlled heating process.

FIG. 5 is a schematic cross-sectional view taken through section line 4–4 of FIG. 3 showing another heat transfer device of the print cartridge of FIGS. 1 and 3 and a controlled heating process. In another embodiment, the integrated heat transfer device 440 is a cutaway of the bottom portion 450 of the inner raised support 430 to form a slotted portion 510 for reducing heat transfer to a top portion 452 of the headland 426, as shown in FIG. 5.

In yet another embodiment, a controlled process is used to heat and cure the adhesive 432 for reducing the amount of heat applied to the printhead body 304 by localizing the application of the heat. Reducing the amount of heat applied to the printhead body 304 reduces the thermal expansion of the headland 426. In particular, hot gimbaled rails 520 can be placed in direct contact with the nozzle member 306 at a contact area 522 to conductively heat and cure the adhesive 432. The contact area 522 is preferably located directly above the adhesive 432 between the nozzle member 306 and the headland 426. Since the rails 520 only contact the nozzle member 306, heat can be applied to a regulated area, such as the contact area 522, with controlled amounts of temperature. For instance, a minimum required amount of heat to cure the adhesive 432 can be applied to a controlled area 460 directly above the adhesive 432.

In addition, an insulator device 530 can be used to insulate other areas from the heat. Namely, an insulated gimbal locating device 530 can be placed in direct contact with the nozzle member 306 at a contact area 532 to insulate certain areas. The contact area 532 is preferably located in direct contact with the headland 426 of the printhead body 304 to reduce the bulk temperature of the body 304 when the body is exposed to the heat. Since the insulated gimbal locating device 530 directly contacts a portion of the headland 426, the temperature of the headland 426 near the contact area 532 can be reduced. As a result of this localized heating method, only a small portion of the headland 426 is heated, thereby efficiently reducing thermal expansion of the headland 426, which reduces bending, deformation and dimpling of the thermal head assembly 302. Consequently, trajectory errors of ejected ink droplets from the nozzles 420 are reduced. It should be noted that the above embodiments could also be performed in combination to further reduce thermal expansion of the printhead body.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printhead having a body, the printhead comprising:

a nozzle member that receives ink from a refillable ink supply for ejecting the ink on a print media;

a headland securing the body to the nozzle member and having an adhesive overflow slot formed within the headland; and a heat transfer device formed within the headland and separate from the adhesive overflow slot to reduce thermal expansion of the headland and body when the printhead is exposed to heat.

2. The printhead of claim 1, wherein the extended overflow slot is located proximate to an adhesive used to secure the headland to the nozzle member between the nozzle member and the body for reducing heat transfer to a top portion of the headland.

3. The printhead of claim 2, wherein the adhesive is cured by an externally controlled heater.

4. The printhead of claim 1, wherein the printhead is coupled to an ink supply for providing ink to the printhead.

5. The printhead of claim 4, wherein the ink supply is a removeably mounted ink container.

6. The printhead of claim 1, wherein the printhead is capable of being supported by a carriage over a print media.

7. The printhead of claim 1, further comprising a substrate having a front surface and an opposing back surface and ink ejection elements formed on the front surface.

8. A printing method for an inkjet printhead, comprising:

selectively reducing thermal expansion of the printhead when the printhead is exposed to heat with a heat transfer device that is formed within a headland of the printhead and separate from an adhesive overflow slot that is formed within the headland for adhesively supporting a nozzle member to the inkjet printhead;

providing ink from an ink supply to the inkjet printhead to enable the inkjet printhead to print the ink; and refilling the ink supply.

9. The method of claim 8, wherein the adhesive overflow slot is located proximate to an adhesive used to secure the headland to the nozzle member between the nozzle member and the body for reducing heat transfer to a top portion of the headland.

* * * * *